US005191722A

United States Patent [19]

Nayyar et al.

[11] Patent Number: 5,191,722

[45] Date of Patent: Mar. 9, 1993

[54] METHOD AND ARRANGEMENT FOR DRYING OF FIRE HOSES

[75] Inventors: Baldev K. Nayyar, Markham; Gabor Kellner, Toronto; Peter Pinchis, Thornhill; Joseph Martinek, Toronto; Anthony Ayuso, Toronto; Julius Weiss, Toronto, all of Canada

[73] Assignee: Her Majesty the Queen in right of Canada, as represented by the Province of Ontario, Toronto, Canada

[21] Appl. No.: 901,945

[22] Filed: Jun. 22, 1992

[51] Int. Cl.[5] ..... F26B 7/00; F26B 5/14

[52] U.S. Cl. ..... 34/12; 34/61; 34/14; 34/69; 34/70; 34/71; 34/104

[58] Field of Search ..... 34/14, 69, 70, 71, 104, 34/105, 106, 21, 95, 211, 107, 12, 60–61

[56] References Cited

U.S. PATENT DOCUMENTS

| | | | |
|---|---|---|---|
| 116,279 | 6/1871 | Drevet | 34/104 |
| 756,717 | 4/1904 | Schools | 34/104 |
| 3,209,466 | 10/1965 | Van Laar | 34/104 |
| 3,213,479 | 10/1965 | Wilkie | 34/104 |
| 4,403,424 | 9/1983 | Wahlstrom et al. | 34/104 |
| 4,459,763 | 7/1984 | Meissner et al. | 34/204 |
| 4,494,584 | 1/1985 | Rognoni | 34/104 |
| 5,027,531 | 7/1991 | Wiens | 34/104 |

*Primary Examiner*—Henry A. Bennett
*Assistant Examiner*—Denise L. F. Gromada

[57] ABSTRACT

An improved arrangement and method of drying fire hoses is disclosed which reduces the time and energy required to dry fire hoses. According to one aspect of the invention, a plug is forced through the hoses prior to drying to strip water from the interior of the hose. According to a different aspect of the invention, a closed loop drying arrangement is used where moist warm air which has passed over the hoses being dried is reconditioned to remove the water at a dehumidifying station, followed by reheating for further drying of the hoses. This closed loop system has improved the efficiency in drying hoses and produced a system which is not seriously affected by changing ambient conditions.

13 Claims, 4 Drawing Sheets

FIG. 1.
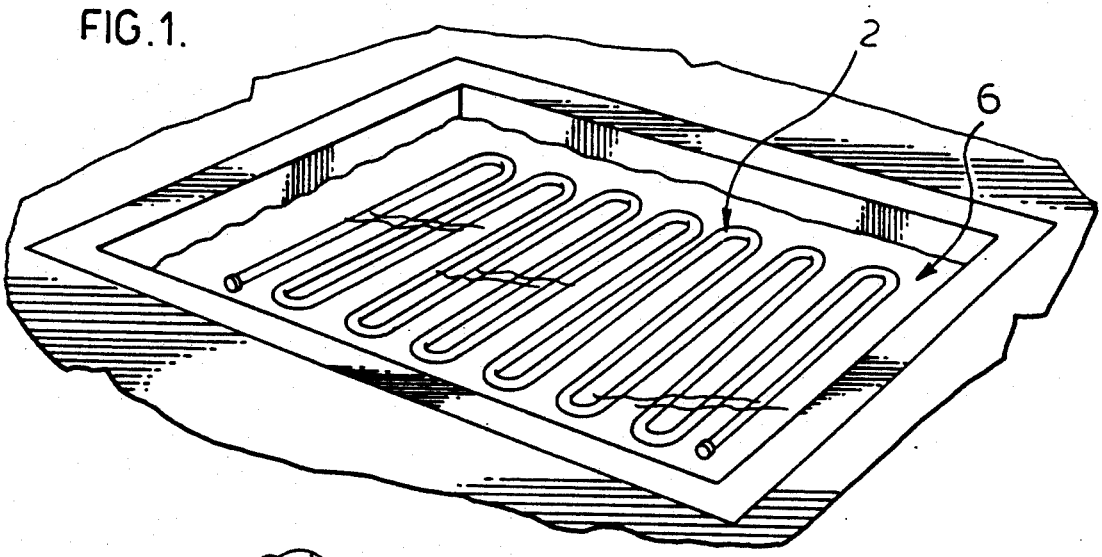
FIG. 2.
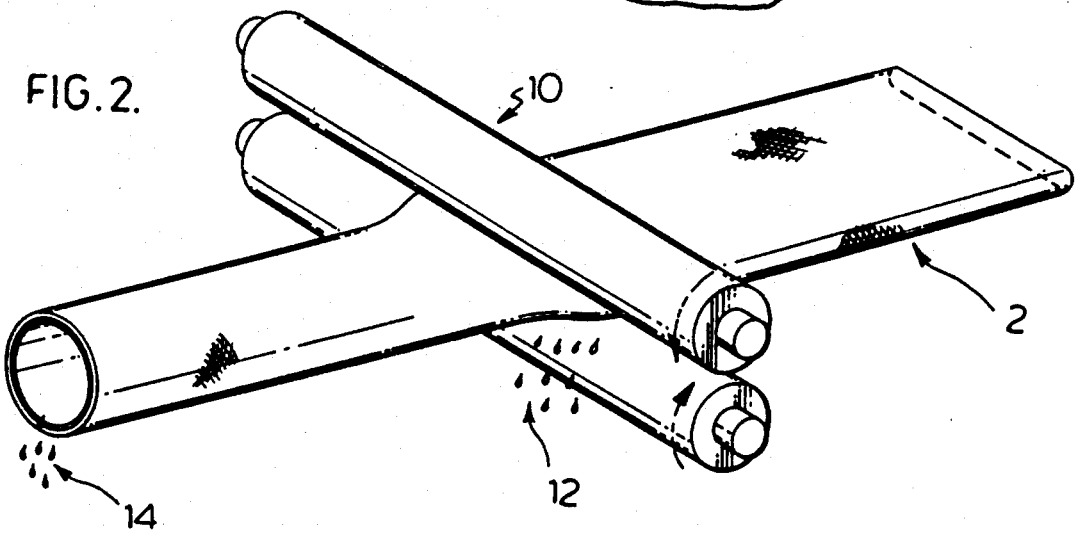
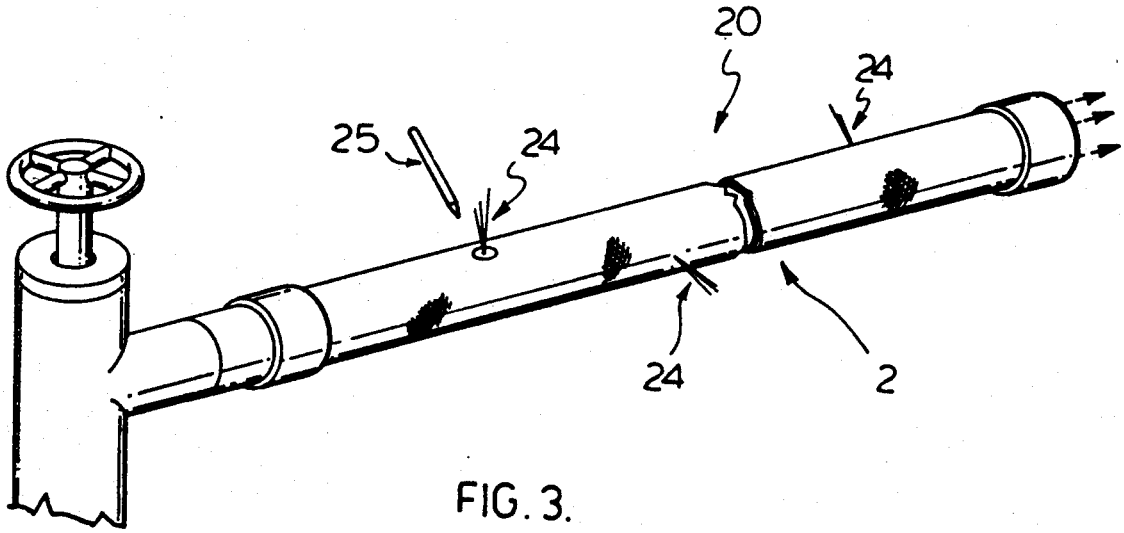
FIG. 3.

METHOD AND ARRANGEMENT FOR DRYING OF FIRE HOSES

FIELD OF THE INVENTION

Fire hoses, after they have been used for fire fighting, require proper cleaning and drying prior to restoring of the fire hose for the next use. If the fire hoses are not properly cleaned and dried, the life of the fire hose is greatly reduced. The present invention relates to an improved method and arrangement for drying of fire hoses.

BACKGROUND OF THE INVENTION

One of the more demanding uses of a fire hose is in supplying water for fighting of forest fires. In the past, it has been argued that forest fires are a natural occurrence and in some areas, such as the Yellowstone Park, the position has been taken to merely allow fires to run their normal course. Many persons and organizations, including government bodies, now recognize that it is beneficial to fight forest fires to reduce the amount of trees that are lost, to protect man-made structures and to reduce the amount of pollutants which result from the forest fire. Fighting of forest fires is generally carried out on three distinct fronts: manual, water bombers and chemical methods. Manual fire fighting methods include men spraying water on the periphery of the forest fire in an effort to stop the advance of the fire. This manual method involves supplying water to the fire fighters and this water is often drawn from a remote source. In extreme cases, water may be pumped from a source as far as ten miles away through fire hoses with various pumps in series along the length of the fire hoses to maintain the pressure. The fire hose, itself, includes an inner liner with an outer fabric layer. The inner liner does not provide a fully water-impermeable barrier and, when water is forced through the length of the hose under pressure, some water does weep through the liner and is absorbed by the outer fabric layer. This is beneficial as the weepage of water through the hoses protects the fire hoses from burning. After the fire hoses have been used in fighting of a forest fire, they require cleaning to remove dirt, sticks and other debris from the fabric surface of the hose as well as remove dirt from the interior of the hose, depending upon the source and quality of the water. In addition, the hoses can be damaged and may require repair to patch small defects. In the past, the hoses have been soaked to remove debris and dirt and then have been hung from rafters or other arrangements to air dry or, in other cases, have been placed in drying arrangements for faster drying of the hoses. Examples of drying arrangements for fire hoses are shown in U.S. Pat. No. 4,403,424, U.S. Pat. No. 976,656, U.S. Pat. No. 984,725, U.S. Pat. No. 684,741, U.S. Pat. No. 4,934,179, U.S. Pat. No. 3,531,059, U.S. Pat. No. 2,471,041, U.S. Pat. No. 4,348,781, U.S. Pat. No. 4,206,526, U.S. Pat. No. 2,909,794, and U.S. Pat. No. 2,784,432.

Forest fires occur primarily during a relatively short season, from the early spring to the late autumn. During that season, fire hoses may be in high demand. It is therefore important to recondition and/or dry the hoses efficiently so that turnaround is quicker and the total number of hoses that need to be warehoused is reduced. There remains a need to provide an efficient arrangement for drying of fire hoses.

SUMMARY OF THE INVENTION

A method of drying fire hoses, according to the present invention, comprises removing dirt and debris from the hoses by applying water thereto, compressing the hoses to remove water therefrom, stripping water from the interior of those by forcing a plug through each hose, with the plug in close contact with the inner liner whereby water on the surface of the inner liner is removed from the hose, and then exposing the hoses to a drying arrangement whereby drying air is circulated under pressure about the hoses to remove water by evaporation from the fabric layer. With this method, the time required for effectively drying of the hoses by circulating air thereabout has been reduced. This reduction is believed to be due to the amount of water that can be removed by forcing a plug through the hose to strip water that is interior to the hose. During the drying operation, trapped water within the hose slowly transfers through the inner liner to the outer fabric layer and if the amount of water is high in the inner liner, then the drying time is high.

According to an aspect of the invention, the step of applying water to the hoses includes soaking of the hoses in water followed by passing water under pressure through the soaked hoses and identifying and marking any areas in the hoses which require repair to remove leaks.

According to yet a further aspect of the invention, the step of compressing the hoses to remove water includes passing the hoses through opposed pressure rollers.

According to yet a further aspect of the invention, the method includes folding of the hoses loosely upon themselves and placing each hose in a separate tray having open sides and an open bottom whereby air can circulate about the hose by passing through the tray, and placing trays with hoses therein in a drying chamber designed to pass dry air about the hoses and remove moisture laden air from the drying arrangement.

According to yet a further aspect of the invention, the step of exposing the hoses to drying air includes blowing heated dry air over the hoses, followed by removing moist air produced by blowing heated dry air over the hoses and dehumidifying the moist air after removal to dry the same and recirculate this dried air whereby the air supplied to the dry hoses is in a closed loop arrangement.

The present invention is also directed to a system for drying of air hoses. The system dries fire hoses which have been previously cleaned and comprises a closed loop forced air circulation system. The forced air circulation system includes a fan arrangement for forcing air through the air circulation system, an air heating station, a hose receiving chamber adapted to receive a plurality of hoses such that air freely circulates thereabout, and a dehumidifying station to receive moist air exhausted from the hose receiving chamber and remove the moisture therefrom, drying air and then returning the dried air to the air heating station. The fan, the air heating station, the hose receiving chamber and the dehumidifying station collectively form a closed loop through which air is circulated.

According to yet a further aspect of the invention, the system includes at least two hose receiving chambers disposed in parallel, with each hose receiving chamber including separate control means for restricting the circulation of air therethrough whereby one chamber may be operated to dry hoses independently of the other chamber and wherein one chamber can be drying hoses, whereas the other chamber may be open to receive hoses for subsequent drying.

According to yet a further aspect of the invention, at least four hose receiving stations are provided, with each hose receiving chamber adapted to receive hoses loosely folded in trays with the exterior surface of the hoses exposed. Each tray is perforated to allow air to pass therethrough and contact a hose disposed in the tray. Each hose receiving chamber is sized to receive at least thirty trays in a generally horizontal orientation.

According to yet a further aspect of the invention, the system includes a hose preparation station where hoses are prepared prior to being placed in the hose receiving chamber. The hose preparation station includes an arrangement for passing a plug through a hose in a manner to strip surface water on the liner of the hose prior to the hose being loosely folded in a tray or other arrangement for receipt in the hose receiving chamber. The plug preferably is forced through the interior of the hose by means of forced air.

BRIEF DESCRIPTION OF THE DRAWINGS

Preferred embodiments of the invention are shown in the drawings, wherein:

FIG. 1 is a partial perspective view showing initial soaking of hoses;

FIG. 2 is a schematic representation of the compression of the soaked hoses to remove water from the hoses;

FIG. 3 shows applying water pressure to the hoses and marking of any areas requiring repair;

DETAILED DESCRIPTION OF THE PREFERRED EMBODIMENTS

Figure 4:
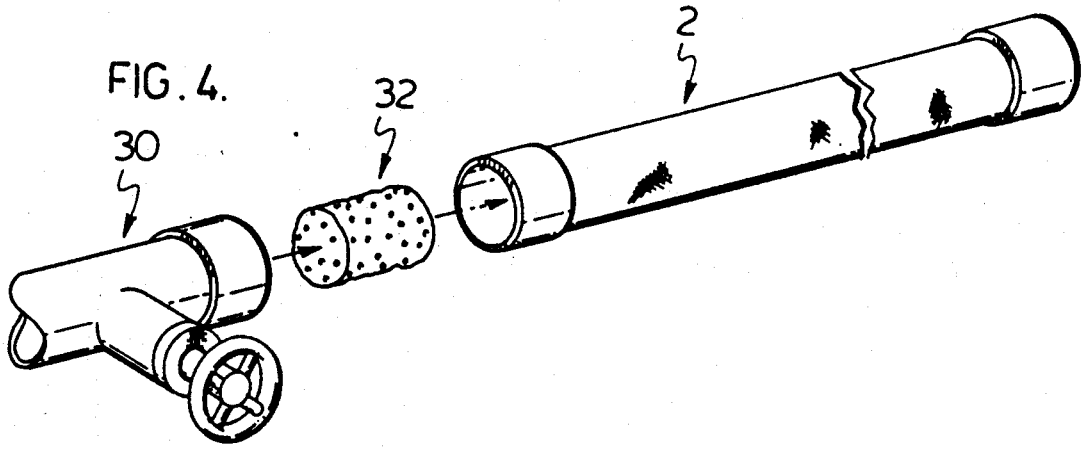
FIG. 4 schematically shows the forcing of a plug through a hose to remove water from the hose.

A fire hose 2 is schematically shown soaking in a pool of water 6. Each hose is typically 100 to 150 feet in length and 1½ inches in diameter. This is the first step in cleaning, drying and reconditioning of a fire hose used in a forest fire and this soaking removes debris and dirt from the fire hose. The fire hose is then removed from this soaking arrangement, which could be a lake, pool or other body of water, while the removed debris and dirt is generally retained in the pool. The hose is then passed through a wringing operation comprising opposed pressure rollers 10 which flatten the hose and displace water 12 from the fabric outer sleeve of the fabric hose as well as some water may be displaced from the inner liner of the hose through the length of the hose, with this water generally indicated as 14.

Figure 5:
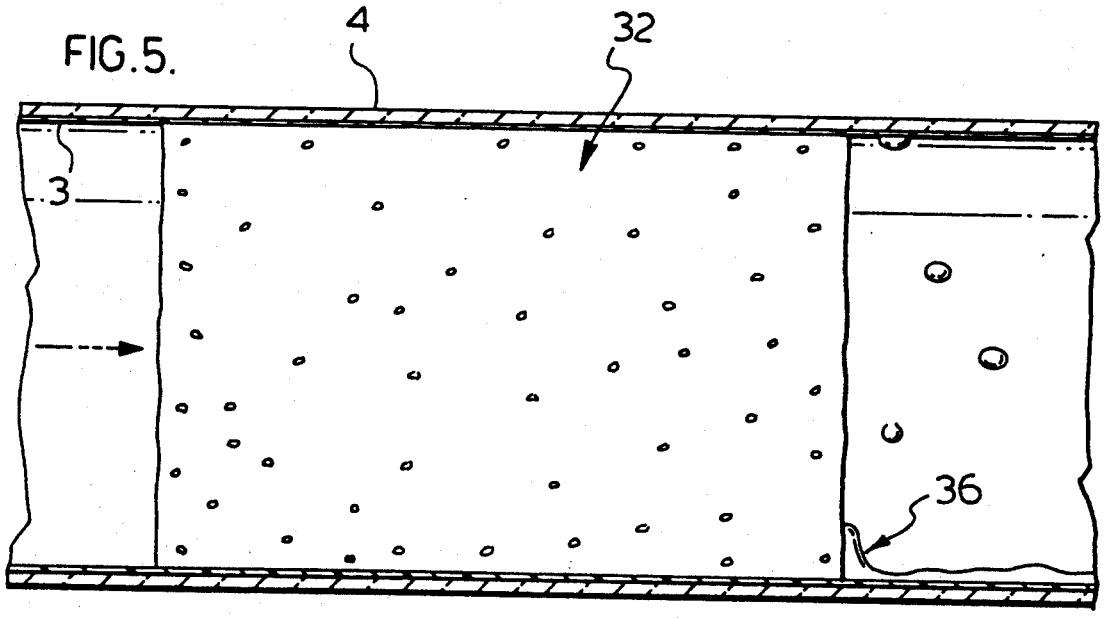
FIG. 5 is a sectional view showing a plug passing through a hose and surface water on the hose being pushed along with the plug and discharged from the end of the hose.
Figure 6:
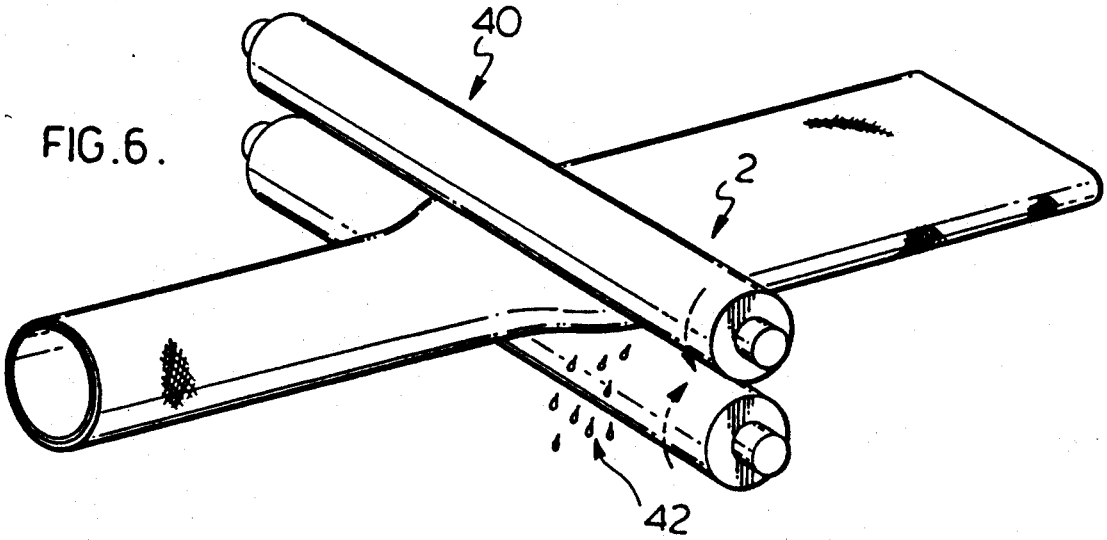
FIG. 6 shows a further compression step to remove any additional water from the fabric layer of the hose.

There is still a significant amount of water retained by the fire hose and the fire hose would not be suitable for final storage at this point. The fire hose, after this preliminary water removal step, is passed to a static hydraulic pressure arrangement where leaks in the length of the fire hose are identified and marked. It can be seen that the fire hose 2 in FIG. 3 is under water pressure or other fluid pressure at level sufficient to allow the detection of damaged areas 24 which require repair. The damaged areas are then marked with an appropriate marker indicated as 25. It can be appreciated that this static pressure test, generally indicated as 20, will add further water to the hose, although it would be properly drained after completion of the static pressure test. The hose then goes under two additional water removal steps, indicated in FIGS. 4, 5 and 6. The first step involves a resilient plug 32 or sponge which is inserted into the fire hose 2 and expands to engage the interior surface of the liner 3 of the fire hose 2. This liner is generally not completely impervious to water, as it is usually desirable for some bleeding or weeping of water to occur through the liner to the outer fabric layer 4 to protect the fire hose if it is exposed to high temperature. By passing the plug 32 through the length of the fire hose under air pressure provided by the air pressure source 30, the plug moves through the length of the hose and wipes the surface of the interior liner 3 and absorbs and/or removes water in a squeegee-like manner which is forced down the length of the hose in advance of the plug 32. This removes water, as generally indicated as 36. Thus, the plug 32 tends to strip water from the surface of the liner 3. In FIG. 6, the hose has again been exposed to a wringing action to remove further amounts of water from the outer fabric layer 4. These mechanical steps of removing water from both the exterior fabric layer and from the surface of the inner liner significantly reduce the amount of time and energy required to effectively dry the hoses in a drying chamber.

Figure 7:
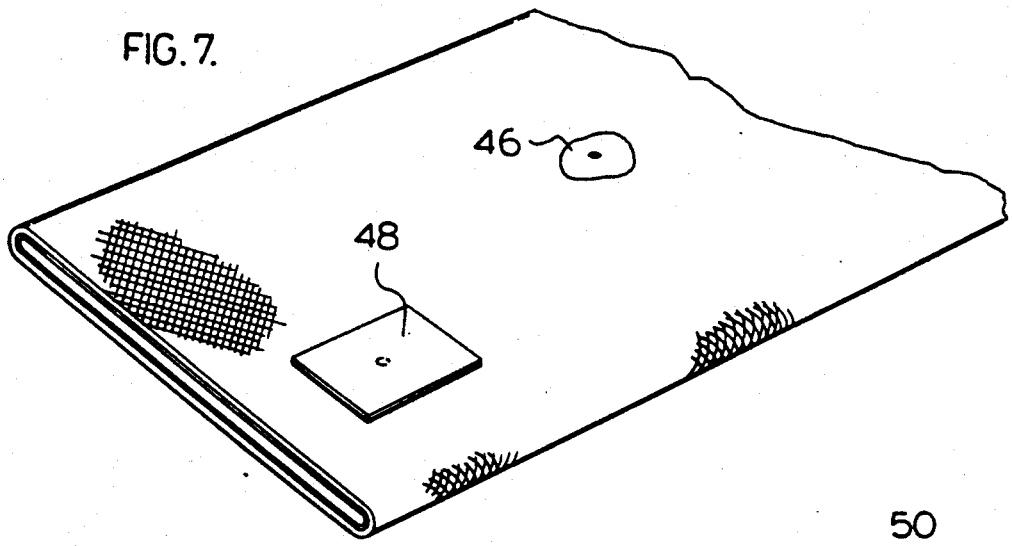
FIG. 7 shows repair of the hose in the areas which have been identified.
Figure 8:
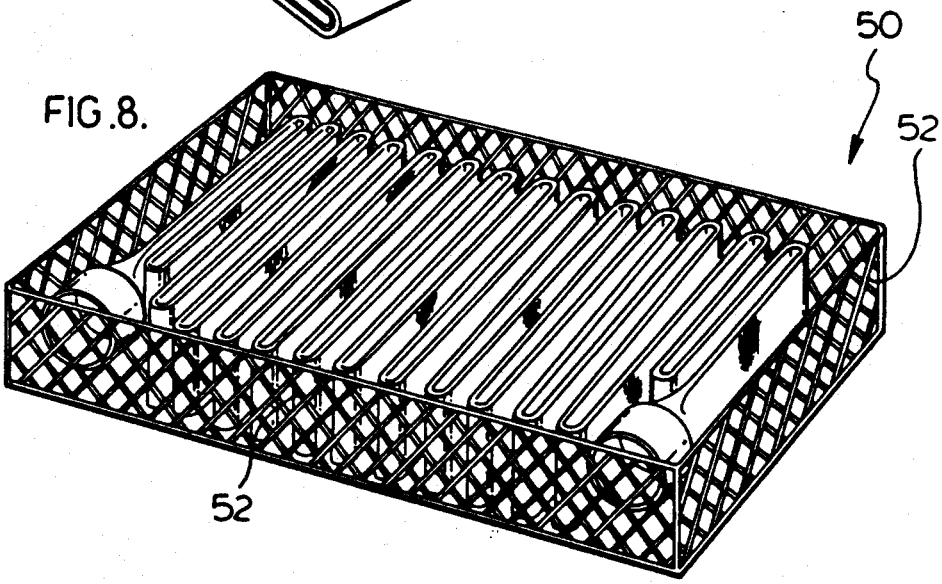
FIG. 8 shows a prepared hose being placed in a tray for drying.
Figure 9:
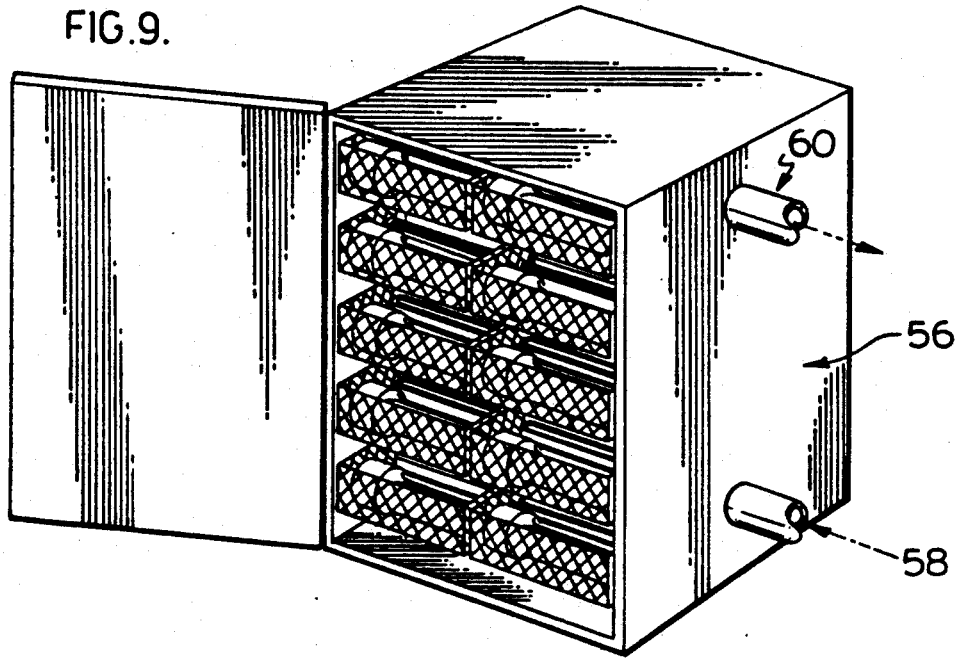
FIG. 9 is a schematic of the hose drying station.

FIG. 7 schematically illustrates the repair of the fire hose prior to the drying step. The various areas which have been marked for repair are then appropriately patched. The repaired areas are 46 and an area about to be repaired is 48. After the various damaged areas have been repaired, the fire hose is loosely folded upon itself in a tray 50 shown in FIG. 8.

Tray 50 includes sidewalls and a bottom comprising a grid network. This tray, which is basically perforated or made of a wire grid to accommodate the free flow of air therethrough, allows the fire hose to be loosely folded in a manner similar to the final storage of the fire hose. The main difference is that the folds are only loose to allow the free access of air to the exterior surface of the fire hose. The trays are preferably about 94 inches long, 18 inches wide, and 3½ inches deep. The trays 50 are in a horizontal orientation and are placed in a drying chamber, indicated as 56. The drying chamber is designed to receive up to thirty trays in a stacked relationship. Dry heated air is introduced through the dry air inlet 58 and air is exhausted from the drying chamber at the air exhaust 60. The air being exhausted will still be relatively hot, but will be quite moisture laden. The air velocity through the drying trays is about 45 feet per minute.

As shown in the drawings, the fire hoses loosely folded in the trays are on edge with the side areas of the hoses disposed to have forced air move across both sides as opposed to one side essentially blocking air flow across the other side or subject to a much higher drying air flow. Therefore, this hose folding of the hoses in the perforated trays, with the placement of the trays across the air flow, is beneficial. The edge of the hose contacting the tray does realize a higher air flow relative to the other edge, but this is not a problem. Furthermore, any moisture interior to the liner is removed by capillary action through the permeable liner to the outer fabric layer on and adjacent to the lower hose edge.

Figure 10:
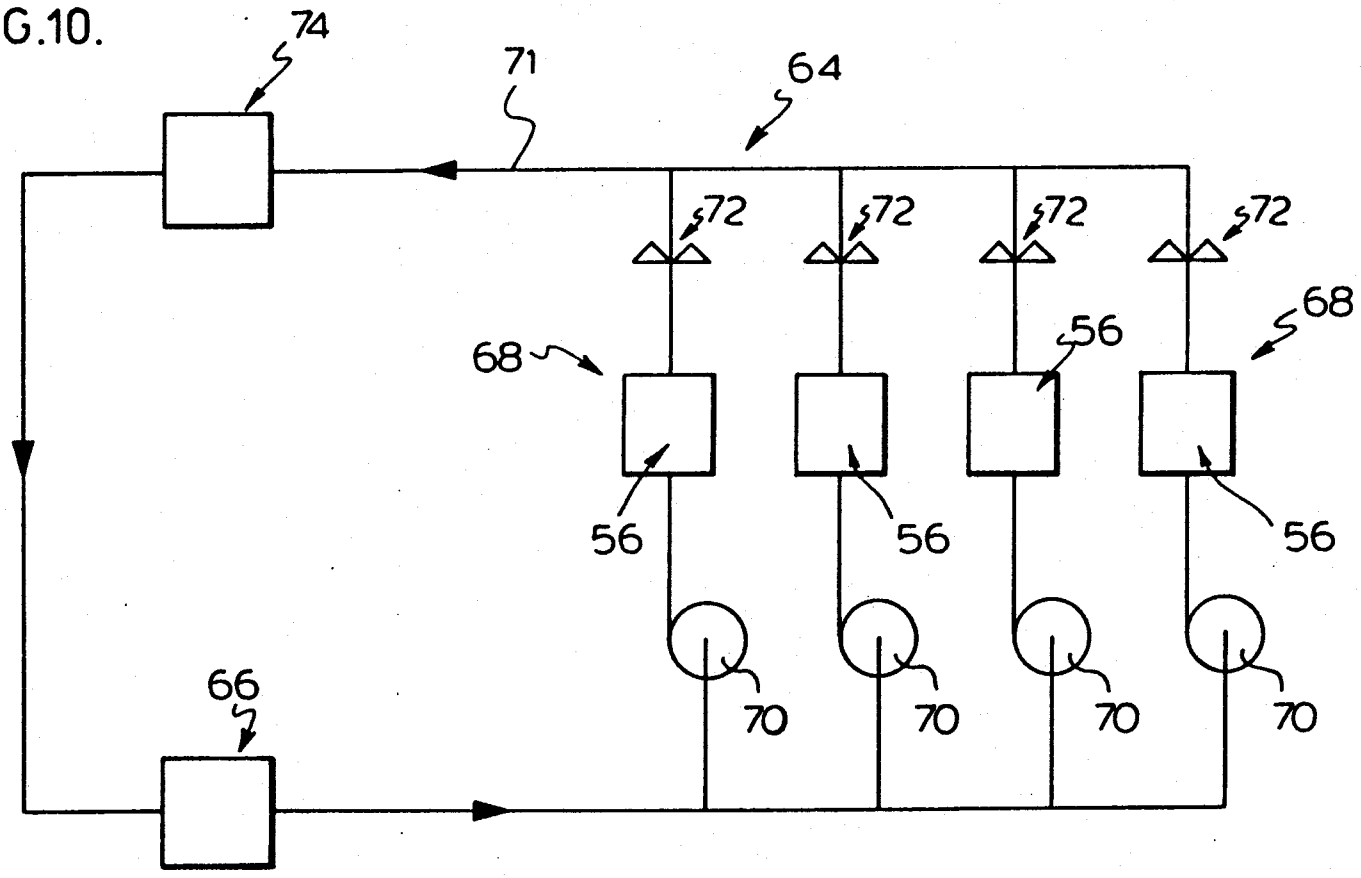
FIG. 10 is a schematic of a hose drying system.

A fire hose drying system 64 is shown in FIG. 10 and forms a closed loop. Heated, dry air is initially passed by the fire hoses in the drying chambers, substantially exhausted from the drying chambers, followed by reconditioning (dehumidifying) and reheating prior to being reintroduced to the drying chambers. The closed loop system includes a furnace 66 for heating of dry air, with the furnace supplying the air to one of four drying stations 68 placed in parallel between the furnace 66 and the dehumidifying station 74. Each drying station 68 includes a separate fan 70, a drying chamber 56 and a control damper 72. The control damper 72 allows the outlet from the drying chamber to be isolated from the supply 71 to the dehumidifying station 74. With this arrangement, the separate fans 70 essentially block the inlets to the drying chamber 56, such that each fan 70 is separately controlled and when the fan is shut down, no appreciable air is passed therethrough. This allows each of the drying chambers 56 to be separately operated whereby one of the drying chambers may be loaded with hoses and then commence a drying cycle by activating the particular fan 70 and opening of the controlled damper 72. The other chambers can be at various stages within a drying cycle or could be being loaded with trays or not in use, in which case the particular fan would not be operated and the controlled damper associated with that drying chamber would be closed. This allows efficient use of labour, as it is not necessary for manpower to remain idle while a full load of hoses is being dried. With this system, only one drying chamber can be used, or the personnel can adjust the system, as required, to allow all chambers to operate at the same point in time or to run each of the chambers with their own cycle.

The air is heated to a temperature of approximately 110° F. It has been found that exposure of the fire hoses to air temperatures greatly in excess of 110° F. causes deterioration of the hoses and significantly shortens the life thereof. Therefore, air is introduced to a drying chamber at approximately 110° F. or less. The air is forced, due to the increase in pressure produced by the particular fan 70, through the drying chamber, with the air circulating about the hoses and removing moisture from the outer fabric layer primarily, with this moisture being removed by evaporation. This results in moist, hot air exiting the drying chamber 56 and passing through the opened, controlled damper 72 to the supply 71 of the dehumidifying station 74. The dehumidifying station 74 strips moisture from the air and returns the air to the furnace or heating station 66. The relative humidity of the air returning to the furnace is approximately 10%. It has been found with this closed loop system that hoses preheated, according to FIGS. 1 to 7, can be effectively dried in a time period of 6 to 8 hours. This is significantly less than previous systems where the hoses often required drying of anywhere from 20 to 24 hours. It is believed that a significant portion of the saving in drying time is due to the stripping of water from the interior of the hose, but also that a further significant portion relates to the use of a closed loop. The closed loop ensures the heated drying air is relatively dry (10% relative humidity), as moisture has been stripped therefrom during the dehumidifying step. Operating without a closed loop, the intake air is at the ambient relative humidity and may be relatively moist and is not efficient.

The hoses within the trays allow effective circulation of air about the hoses, but do not allow a significant flow of air through the hoses to strip moisture from the interior of the hose. The inner liner 3 of the fire hose is capable of allowing water to pass slowly therethrough by a capillary-like action and, previously, the hoses would appear to be dry on the outside surface, however, any movement of the hose would result in soaking of the fabric layer at particular points due to water passing through the inner layer and being absorbed in the outer layer. The water transfers by a capillary-like action and this is a very time consuming manner for removing water from the interior liner of the fire hose. Failure to remove this water, which previously was only removed by exposing the fire hose to extended periods of time in the drying chamber, will significantly reduce the life of the hose and essentially defeats the drying process. By stripping the water from the interior of the hose by means of forcing the plug or sponge through the length of the hose, the amount of water on the interior of the hose is greatly reduced and this soaking problem previously experienced is greatly reduced or avoided. Therefore, the amount of water that must pass through the liner, either during the drying process or shortly thereafter, has been reduced to the extent that it is not detrimental to the life the fire hose and this has been accomplished while shortening drying time in the drying chamber 56. This shortened drying time for fire hoses is a result of the combination closed loop fire hose drying arrangement of FIG. 10 as well as the improved water stripping action resulting from passing of the resilient plug through the interior of the fire hoses prior to being received in the drying trays. It can also be appreciated that the fire hoses are easily placed in their final folded condition once they have been removed from the drying chamber merely by compressing the loosely folded arrangement.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A method of reconditioning and drying a fire hose of the type having a fabric outer layer and an inner liner layer, said method comprising removing dirt and debris from the hoses by applying water thereto, compressing the hoses to remove water therefrom, stripping water from the interior of the hose by forcing a plug through each hose with the plug in close contact with said inner liner whereby water on the surface of said inner liner is removed from the hose, and exposing said hoses to a drying arrangement where drying air is circulated about said hoses to remove water by evaporation from said fabric layer.

2. A method of reconditioning and drying a fire hose as claimed in claim 1 wherein said step of applying water to the hoses includes soaking of the hoses in water.

3. A method of reconditioning and drying a fire hose as claimed in claim 1 wherein said step of applying water to the hoses includes soaking of the hoses in water followed by passing water under pressure through the soaked hoses and identifying and marking any areas in the hoses which require repair to remove leaks.

4. A method of reconditioning and drying a fire hose as claimed in claim 1 wherein said step of compressing the hoses includes passing the hoses through opposed pressure rollers.

5. A method of reconditioning and drying a fire hose as claimed in claim 1 including folding of said hoses loosely upon themselves and placing each hose in a separate tray having open sides and bottom whereby air can circulate about the hose by passing through the tray and placing said trays with hoses therein in a drying chamber designed to pass dry air about said hoses and remove moisture laden air.

6. A method of reconditioning and drying a fire hose as claimed in claim 1 wherein said step of exposing the hoses to drying air includes blowing heated dry air over the hoses, removing moist air, dehumidifying the moist air to dry the same and reheating the dried air whereby the air applied to dry the hoses is in a closed loop arrangement.

7. A method of reconditioning and drying a fire hose as claimed in claim 1 wherein the plug is a resilient sponge which, due to its resiliency, wipes the walls of the liner as the plug is forced under pressure through a hose.

8. A method of reconditioning and drying a fire hose as claimed in claim 7 wherein the plug is forced by air pressure through the hose.

9. A method of drying a fire hose of the type having a fabric outer layer and an inner liner layer, said method comprising compressing the hoses to remove water therefrom, stripping water from the interior of the hose by forcing a plug through each hose with the plug in close contact with said inner liner whereby water on the surface of said inner liner is removed from the hose, and exposing said hoses to a drying arrangement where drying air is circulated about said hoses to remove water by evaporation from said fabric layer.

10. A method of drying a fire hose as claimed in claim 9 including folding of said hoses loosely upon themselves and placing each hose in a separate tray having open sides and bottom whereby air can circulate about the hose by passing through the tray and placing said trays with hoses therein in a drying chamber designed to pass dry air about said hoses and remove moisture laden air.

11. A method of drying a fire hose as claimed in claim 9 wherein said step of exposing the hoses to drying air includes blowing heated dry air over the hoses, removing moist air, dehumidifying the moist air to dry the same and reheating the dried air whereby the air applied to dry the hoses is in a closed loop arrangement.

12. A method of drying a fire hose as claimed in claim 9 wherein the plug is a sponge which absorbs water and due to its resiliency wipes the walls of the liner as the plug is forced under pressure through a hose.

13. A method of drying a fire hose as claimed in claim 12 wherein the plug is forced by air pressure through the hose.

* * * * *